United States Patent [19]

Aykut, deceased et al.

[11] Patent Number: 4,520,614

[45] Date of Patent: Jun. 4, 1985

[54] APPARATUS FOR INTRODUCING STACKS OF PAPER SHEETS OR THE LIKE INTO CARTONS

[76] Inventors: Kurt Aykut, deceased, late of Hamburg, Fed. Rep. of Germany; by Eva-Marie Aykut, executor, Barmbeker Str. 177, D-2000 Hamburg 60, Fed. Rep. of Germany; Wolfram Wolf, Holsteinhausstr. 1, D-2081 Bilsen, Fed. Rep. of Germany

[21] Appl. No.: 473,732

[22] Filed: Mar. 9, 1983

[30] Foreign Application Priority Data

Mar. 9, 1982 [DE] Fed. Rep. of Germany ..... 3208388

[51] Int. Cl.[3] ..... B65B 35/52

[52] U.S. Cl. ..... 53/540; 53/247; 53/258

[58] Field of Search ..... 53/247, 258, 540

[56] References Cited

U.S. PATENT DOCUMENTS

| | | | |
|---|---|---|---|
| 3,001,347 | 9/1961 | Taylor | 53/247 |
| 3,483,802 | 12/1969 | Heyne | 53/247 |
| 3,943,681 | 3/1976 | Preisig | 53/247 |
| 4,159,761 | 7/1979 | Egee et al. | 53/540 |

*Primary Examiner*—W. D. Bray
*Assistant Examiner*—Jorji M. Griffin
*Attorney, Agent, or Firm*—Peter K. Kontler

[57] ABSTRACT

Relatively tall stacks of paper sheets are introduced into successive cartons from above while the cartons are confined in the chamber of a receptacle whose side walls prevent excessive outward bulging of the adjacent side walls of the carton when a stack descends toward the carton in a vertical duct whose cross-sectional area is just sufficient to allow the stacks to descend. Each descending stack pushes a column of air into the carton wherein the air is compressed and urges the side walls of the carton against the respective side walls of the receptacle. The upper end of the duct receives stacks from an upright container having a bottom wall which is movable between open and closed positions. A side wall of the receptacle is detachable or otherwise movable to an open position so as to allow for insertion of empty cartons into or for removal of filled cartons from the chamber. The lower end portion of the duct rests on the upper edges of side walls of the receptacle to prevent air from escaping into the atmosphere at a high rate while a stack descends in the duct and pushes a column of air into the carton therebelow.

11 Claims, 2 Drawing Figures

APPARATUS FOR INTRODUCING STACKS OF PAPER SHEETS OR THE LIKE INTO CARTONS

BACKGROUND OF THE INVENTION

The present invention relates to carton filling apparatus in general, and more particularly to improvements in apparatus of the type wherein the carton to be filled is inserted into a receptacle so that its open side faces upwardly and can receive a stack of paper sheets or the like, preferably from a container which is mounted at a level above the receptacle.

It is already known to provide the container above the receptacle for cartons with a bottom wall which is movable between open and closed positions so that a stack of sheets can drop by gravity into the empty carton therebelow as soon as the bottom wall is moved to open position. As a rule, the stacks constitute reams of 500 sheets each, i.e., the stacks are relatively low and the equally low side walls of the cartons for reception of such stacks exhibit a tendency to bulge outwardly and against the adjacent portions of the receptacle so that a stack can readily enter the carton therebelow. In other words, the size of the opening at the top of an empty carton is normally large enough to allow for unimpeded entry of the stack which descends from the container as soon as the bottom wall of the container is retracted or otherwise moved out of the way. Apparatus of such type are disclosed, for example, in U.S. Pat. No. 4,237,674 granted Dec. 9, 1980 to Aykut.

It was also proposed to assemble the bottom wall of the container from several panels which are pivoted downwardly into the open top of a carton therebelow so that the panels maintain the carton in requisite position for reception of a stack. A drawback of such apparatus is that each freshly filled carton must be lowered to a level below the panels of the bottom wall in order to enable the panels to reassume those positions in which they are capable of supporting a stack in the container. Lowering of filled cartons necessitates the use of additional equipment and slows down the rate at which the apparatus can fill successive cartons with stacks of paper sheets or the like. Therefore, apparatus wherein the bottom wall is retracted in a horizontal plane are preferred when cartons are to be filled at a high frequency. However, such apparatus are not satisfactory when a carton is to accommodate a relatively tall or very tall stack of paper sheets, e.g., a stack containing five reams of 500 sheets each or a single stack of, for example, 2500 sheets. This is due to the fact that a carton, whose side walls are sufficiently high to confine a stack of 2500 superimposed sheets, does not exhibit the required stability as to form, i.e., the side walls of the empty carton tend to bulge inwardly and to thus prevent unimpeded entry of a tall stack. Proposals to enhance the stability of cartons by making their walls of thicker and hence more rigid material are not favored by manufacturers and processors of paper sheets because such cartons are heavy, expensive and take up more room than standard cartons with relatively thin and hence flexible side walls.

OBJECTS AND SUMMARY OF THE INVENTION

An object of the invention is to provide a novel and improved apparatus which can rapidly and predictably introduce tall stacks of paper sheets or the like into cartons having walls of relatively low stability as to form.

Another object of the invention is to provide an apparatus which can rapidly and predictably introduce tall stacks of paper sheets or the like into cartons with yieldable side walls including cartons having one or more composite side walls.

A further object of the invention is to provide the apparatus with novel and improved means for confining cartons during introduction of commodities into their interior.

An additional object of the invention is to provide the apparatus with novel and improved means for automatically ensuring that a carton which is about to receive a stack of paper sheets or the like is in an optimum condition for unimpeded introduction of the stack into its interior.

Another object of the invention is to provide an apparatus which allows for filling of tall cartons at a frequency and with a degree of reproducibility which cannot be matched by heretofore known apparatus.

Still another object of the invention is to provide the apparatus with novel and improved means for guiding successive commodities from the bottom wall of a container for stacked goods into the interior of a carton or an analogous confining device.

An additional object of the invention is to provide a novel and improved method of preventing inward bulging of deformable walls of relatively tall cardboard cartons or analogous confining devices preparatory to and during filling of such devices with stacks of paper sheets or the like.

A further object of the invention is to provide an apparatus which can fill tall cartons at a frequency considerably exceeding that which is achievable with heretofore known apparatus.

The invention resides in the provision of an apparatus for introducing stacks of paper sheets or the like into open-top cartons having side walls which tend to bulge outwardly in response to a rise of air pressure in the interior of the cartons. The apparatus comprises an open-top receptacle which defines a chamber for reception of one carton at a time in such orientation that the open top of the carton in the chamber faces upwardly, a duct which extends upwardly from the open top of the receptacle and has a cross-sectional area at least approximating the format of the stack which is to be introduced into the carton in the chamber of the receptacle, and means for feeding stacks into the duct so that a stack which descends in the duct compresses the air therebelow and causes the thus compressed air to urge the side walls of the carton in the chamber against the receptacle, i.e., the carton is ready to receive the descending stack.

The duct has an open upper end portion for reception of stacks and an open lower end portion which is in at least substantial register with the open top of the carton in the chamber of the receptacle so that at least a high percentage of air which is forced to flow downwardly through the duct during descent of a stack in the duct is compelled to enter into and to be compressed in the interior of the carton in the chamber of the receptacle. It can be said that the side walls of the duct define a path having an open upper end for reception of stacks and an open lower end which is in register with the open top of the carton in the chamber of the receptacle. The path is at least substantially sealed from the surrounding atmosphere all the way from its upper to its lower end.

The feeding means can comprise a container for stacks. The container has a bottom wall above the open upper end of the path which is defined by the duct and means for moving the bottom wall to and from an open position in which a stack can descend by gravity from the interior of the container into the duct to advance along the path which is defined by the duct and to thereupon enter the interior of the carton in the chamber of the receptacle. The feeding means can further comprise conveyor means for delivering stacks onto the bottom wall of the container. The latter can store several superimposed stacks which descend, in the form of a single composite stack, into the duct in response to movement of the bottom wall of the container to open position.

The receptacle preferably comprises side walls which surround all side walls of the carton in the chamber. For example, the receptacle can comprise four upright side walls, one for each side wall of a standard box-like carton. Each side wall of the duct can constitute an upward extension of the respective side wall of the receptacle; this greatly reduces the likelihood of uncontrolled escape of air from the duct during descent of a stack into the carton which is confined in the chamber of the receptacle. The side walls of the receptacle and of the duct may but need not be vertical.

One side wall of the receptacle can be mounted in such a way that it constitutes a door which is movable to and from an open position in which a carton can be inserted into or withdrawn from the chamber while the duct remains attached to the receptacle.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
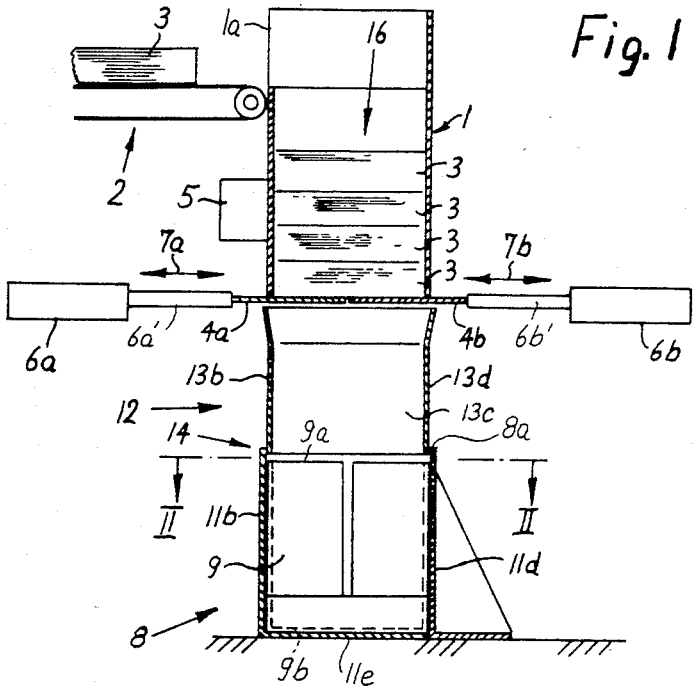
FIG. 1 is a schematic partly side elevational and partly vertical sectional view of an apparatus which embodies the present invention, an empty carton being shown in the chamber of the receptacle and the bottom wall of the container being shown in closed position.
Figure 2:
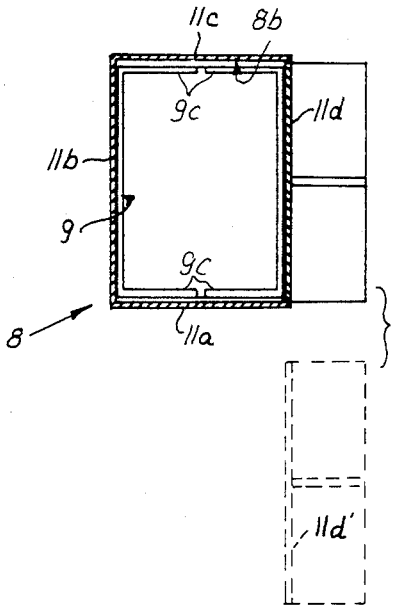
FIG. 2 is a horizontal sectional view as seen in the direction of arrows from the line II—II of FIG. 1.

The apparatus which is shown in FIGS. 1 and 2 comprises a receptacle 8 which can be fixedly installed in upright position so that its open top 8*a* faces upwardly. The receptacle 8 defines a chamber 8*b* which is just large enough to receive a carton 9, e.g., a cardboard carton having an open top 9*a*, a bottom wall 9*b* which rests on the bottom wall 11*e* of the receptacle 8, and four upright side walls which are inwardly adjacent to the respective side walls 11*a*, 11*b*, 11*c*, 11*d* of the receptacle 8. The side wall 11*d* of the receptacle 8 is movable between the illustrated closed position and an open position 11*d'* in which the receptacle 8 defines a lateral opening large enough to allow for insertion of an empty carton 9 into or for withdrawal of a filled carton from the chamber 8*b*. As shown, the entire side wall 11*d* can be simply detached from the walls 11*a*, 11*c*, 11*e* to provide an opening which is sufficiently large to allow for insertion or removal of a carton. The illustrated carton 9 has two two-piece side walls each including two flaps 9*c* which are pivotable with reference to each other. The side walls of the carton 9 are assumed to be flexible so that, in the absence of any means for preventing inward bulging of the side walls of the carton in the chamber 8*b*, such side walls would tend to reduce the cross-sectional area of the open top 9*a* below that which is required for unimpeded entry of a stack of commodities, e.g., a composite stack 16 consisting of 2000 or 2500 superimposed paper sheets, into the interior of the carton in the chamber 8*b*.

The receptacle 8 is installed at a level below and is spaced apart from a container 1 having a mobile two-piece bottom wall 4*a*, 4*b* and a lateral inlet 1*a* for admission of successive stacks 3 which are supplied by the upper reach of an endless belt or chain conveyor 2. Successive stacks 3 enter the interior of the container 1 and accumulate on top of each other so as to form a composite stack 16 of, for example, five reams, i.e., a total of 2500 sheets. The container 1 resembles a vertical chute having a cross-sectional outline complementary to the format of the stacks 3, i.e., each of the stacks 3 resting on the panels or sections 4*a*, 4*b* of the bottom wall or on a stack therebelow is snugly confined in the respective portion of the container 1.

The means for moving the panels or sections 4*a*, 4*b* of the composite bottom wall of the container 1 between open and closed positions comprises two horizontal motion transmitting members 6*a'*, 6*b'*constituting the piston rods of two preferably pneumatic double-acting cylinder and piston units 6*a*, 6*b*. These units can be actuated in automatic response to delivery of a given number of stacks 3 into the container 1 and upon receipt of a signal that an empty carton 9 is properly confined in the chamber 8*b* of the receptacle 8. The directions in which the bottom wall sections or panels 4*a* and 4*b* are reciprocable by the respective cylinder and piston units 6*a*, 6*b* are indicated by double-headed arrows 7*a* and 7*b*. FIG. 1 shows the sections 4*a*, 4*b* of the bottom wall in closed positions so that the container 1 can accumulate a supply of superimposed stacks 3, i.e., a composite stack 16 which is ready for introduction into the carton 9 in the chamber 8*b* of the receptacle 8.

When the sections 4*a* and 4*b* of the bottom wall of the container 1 are held in the illustrated closed positions, the container 1 acts not unlike a cylinder and the successively delivered stacks 3 act not unlike pistons which are automatically braked during gravitational descent onto the bottom wall sections 4*a*, 4*b* or onto a stack therebelow because the cross-sectional area of the container 1 equals or closely approximates the format of the sheets which constitute the stacks 3. Thus, an air cushion develops below each descending stack 3, and such cushions automatically decelerate the respective stacks 3 on their way into the lowermost portion of the container 1 or onto the partially assembled composite stack in such container.

The reference character 5 denotes a vibrator which shakes the container 1 and enables successively delivered stacks 3 to align themselves in the interior of the container so that they form a neat composite stack 16 which is ready to descend as soon as the bottom wall sections 4*a*, 4*b* move to their open positions.

In accordance with a feature of the invention, the apparatus further comprises an upright duct 12 which is disposed between the bottom wall sections 4*a*, 4*b* and the open top 8*a* of the receptacle 8 and defines a vertical path having an open upper end arranged to receive composite stacks 16 on opening of the bottom wall of the container 1 and an open lower end in communication with the open top 9*a* of the carton 9 in the chamber 8*b* of the receptacle 8. The four side walls of the duct 12 (only the side walls 13*b*, 13*c*, 13*d* can be seen in FIG. 1) seal the just mentioned path from the surrounding atmosphere all the way from the open upper end to the open lower end of the duct. The lower end portions of the side walls of the duct 12 can be bent inwardly or outwardly (as at 14) so as to be seated on the top portions of side walls 11*a* to 11*d* of the receptacle 8 and to thus reduce the rate of or to prevent air flow between the atmosphere and the interior of the carton 9 in the chamber 8*b* in the region where the duct 12 rests on the receptacle 8. The side walls of the duct 12 can be made integral with the corresponding side walls of the receptacle 8, except that the side wall 11*d* should be free to move to the open position 11*d*' so as to allow for insertion of empty cartons 9 into or for removal of filled cartons from the chamber 8*b*.

The duct 12 and the receptacle 8 can be said to constitute a cylinder which serves for reception of a piston consisting of, for example, five superimposed stacks 3 when the bottom wall sections 4*a* and 4*b* are moved to open positions. The composite stack 16 descends in the duct 12 by gravity and forces air from the interior of the duct 12 into the interior of the carton 9 in the receptacle 8 so that the side walls of the carton tend to bulge outwardly and abut against the respective side walls of the receptacle. This ensures that the composite stack 16 can readily enter through the open top 9*a* of the carton 9 in the chamber 8*b* as well as that such composite stack is automatically braked during downward movement into the receptacle 8. It has been found that the improved apparatus ensures gentle treatment of stacks 3 during transfer from the upper reach of the conveyor 2 into successive cartons 9 in the chamber 8*b*.

The cross-sectional area of the major part of the duct 12 equals the format of sheets which form the stacks 3 so that each composite stack 16 reliably compresses air in the duct 12 and in the carton 9 during downward movement from the lower end of the duct 1 into the receptacle 8.

The receptacle 8 can be modified by omitting one or more of its side walls 11*a* –11*d*. For example, the wall 11*b* can be omitted if the corresponding side wall of the carton 9 is a one-piece panel which offers adequate resistance to inward bending in spite of the relatively pronounced height of the carton. The feature that the side walls of the duct 12 actually merge into the corresponding side walls of the receptacle 8 ensures that the pressure of air in the carton 9 (during downward movement of a composite stack 16) is sufficiently high to invariably maintain the side walls of the carton in abutment with the adjacent side walls of the receptacle 8.

It is clear that the cross-sectional area of a carton 9 in the chamber 8*b* of the receptacle 8 at least slightly exceeds the cross-sectional area of a stack 16 so that compressed air which accumulates in the carton during downward movement of a stack 16 along the path which is defined by the duct 12 is nevertheless free to escape from the carton 9 but only at a relatively low rate so that the cushion of air in the carton inevitably ensures gentle descent of the stack 16 into the interior of the receptacle 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for introducing stacks of paper sheets or the like into open-top cartons having side walls which tend to bulge outwardly in response to a rise of air pressure in the cartons, comprising an open-top receptacle defining a chamber for reception of cartons in such orientation that the open top of the carton in the chamber faces upwardly, said receptacle including walls surrounding all side walls of a carton in said chamber; a duct extending upwardly from the open top of said receptacle and having a cross-sectional area at least substantially matching the format of the stack which is to be introduced into the carton in the receptacle below the duct; and means for feeding stacks into said duct whereby a stacks which descends in said duct compresses the air therebelow and causes the thus compressed air to urge the side walls of the carton in said chamber against said receptacle.

2. The apparatus of claim 1, wherein said duct has an open upper end portion for reception of stacks and an open lower end portion in at least substantial register with the open top of the carton in said chamber so that at least a substantial percentage of air which is forced downwardly during descent of a stack in said duct is compelled to enter into and to be compressed in the interior of the carton in said chamber.

3. The apparatus of claim 1, wherein said duct has side walls defining a path having an open upper end for reception of stacks and an open lower end in register with the open top of the carton in said chamber, said path being at least substantially sealed from the surrounding atmosphere intermediate said upper and lower ends thereof.

4. The apparatus of claim 1, wherein said duct has an open upper end and said feeding means comprises a container for stacks, said container having a bottom wall above the upper end of said duct and means for moving said bottom wall to and from an open position in which a stack can descend by gravity from the interior of said container into said duct.

5. The apparatus of claim 4, further comprising conveyor means for delivering stacks onto the bottom wall of said container.

6. The apparatus of claim 1, wherein said receptacle includes four upright walls bounding said chamber.

7. The apparatus of claim 1, wherein said duct has a plurality of side walls, one for each side wall of said receptacle, the side walls of said duct constituting upward extensions of the respective side walls of said receptacle.

8. The apparatus of claim 7, wherein the side walls of said duct and the side walls of said receptacle are at least substantially vertical.

9. The apparatus of claim 1, wherein said receptacle has a mobile side wall.

10. The apparatus of claim 9, wherein the side wall of said receptacle is movable to and from an open position in which a carton is insertable into and removable from said chamber.

11. Apparatus for introducing stacks of paper sheets or the like into open-top cartons having side walls which tend to bulge outwardly in response to a rise of air pressure in the cartons, comprising an open-top receptacle defining a chamber for reception of cartons in such orientation that the open top of the carton in the chamber faces upwardly, said receptacle having a side wall movable to and from an open position in which a carton is insertable into and removable from said chamber; a duct extending upwardly from the open top of said receptacle and having a cross-sectional area at least substantially matching the format of the stack which is to be introduced into the carton in the receptacle below the duct; and means for feeding stacks into said duct whereby a stack which descends in said duct compresses the air therebelow and causes the thus compressed air to urge the side walls of the carton in said chamber against said receptacle.

* * * * *